US007274904B2

(12) United States Patent
Yasui

(10) Patent No.: US 7,274,904 B2
(45) Date of Patent: Sep. 25, 2007

(54) IMAGE FORMING APPARATUS

(75) Inventor: Kazumasa Yasui, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 188 days.

(21) Appl. No.: 10/990,126

(22) Filed: Nov. 15, 2004

(65) Prior Publication Data

US 2006/0104686 A1 May 18, 2006

(51) Int. Cl.
*G03G 15/00* (2006.01)

(52) U.S. Cl. ..... 399/388; 399/302

(58) Field of Classification Search ..... 399/388, 399/22, 397, 398, 302, 18, 21, 315
See application file for complete search history.

(56) References Cited

U.S. PATENT DOCUMENTS 3,819,266 A * 6/1974 Price ..... 355/64
3,873,196 A * 3/1975 Ogawa ..... 399/76
5,061,967 A * 10/1991 Isobe ..... 399/316
5,502,545 A * 3/1996 Tsuruoka ..... 399/21
5,606,913 A * 3/1997 Kowalewski ..... 101/183
5,970,295 A * 10/1999 Samizo ..... 399/309
6,347,196 B1 * 2/2002 Kawabata et al. ..... 399/16

FOREIGN PATENT DOCUMENTS

JP PH09-282209 11/1997
JP PH11-59962 3/1999
JP 2002-258689 9/2002

* cited by examiner

*Primary Examiner*—Anthony Nguyen
(74) *Attorney, Agent, or Firm*—SoCal IP Law Group LLP; Steven C. Sereboff; John E. Gunther

(57) ABSTRACT

An image forming apparatus comprises: an intermediate transfer belt having a belt surface on which a toner image is formed while the belt surface is moved and transferring the toner image that has been formed on the belt surface onto a sheet to be fed by a feed section; a resist roller pair that is disposed at a position on the upstream side from a transfer position at which the toner image that has been formed on the belt surface is transferred onto the sheet in the sheet feeding direction and performs a resist operation before the sheet has been fed to the transfer position as well as constitutes the feed section; a belt surface sensor that is disposed at a position on the downstream side from the transfer position in the belt surface moving direction such that the sheet moving distance from the sheet holding position between the resist roller pair to the position becomes shorter than the length of the sheet in the feeding direction and detects the sheet on the belt surface; and a control unit that allows the feed section to stop the sheet feeding operation at the time when the belt surface sensor detects the sheet.

18 Claims, 5 Drawing Sheets

IMAGE FORMING APPARATUS

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

BACKGROUND OF THE INVENTION

1. Field of the Invention

The present invention relates to an image forming apparatus that forms an image on a sheet using an intermediate transfer belt.

2. Description of the Related Art

Among image forming apparatuses that form an image on a sheet using an intermediate transfer belt, apparatuses that adopt a method of separating a sheet that has been stuck to the belt surface of the intermediate transfer belt at the feeding time from the belt surface by pressing a nail-like member or the like against the belt surface using, for example, a solenoid have been available. In some cases, the sheet may be stuck fast to the belt surface in such a manner that any portions of the sheet are not apart from the belt surface. The thicknesses of most of the sheet that are easily stuck to the belt surface as described above are as thin as about 0.1 mm or less. Therefore, the nail-like member may scratch the belt surface at the time when the thin sheet is separated from the belt surface. The scratch on the belt surface prevents good toner adhesion, resulting in image deterioration. On the other hand, when a configuration that the nail-like member is disposed near the belt surface in a fixed manner without using the solenoid is adopted, it is necessary to strictly adjust the disposition of the nail-like member in the manufacturing process. In order to cope with the problem, a configuration in which a sensor that detects that a sheet has been stuck to the belt surface is provided and the entire function of the apparatus is halted when the sensor detects the sheet stuck to the belt surface is disclosed (for example, see Japanese Patent Laid-Open Publication No. 11-59962 (pages 4 to 8, FIG. 1)).

However, the intermediate transfer belt is in contact with a photoreceptor drum or the like, so that it is impossible to stop the intermediate transfer belt instantaneously due to influence of inertial force or the like caused by own weight of the photoreceptor drum even if the entire system is halted at the time when the adhesion of the sheet to the belt surface is detected. In this case, it is impossible to give enough braking force to the sheet, with the result that the sheet may not be stopped at a desired position and may enter the inside of the apparatus while being stuck fast to the belt surface.

In the case where the sheet has entered the inside of the apparatus with the movement of the belt surface as described above, the apparatus may break down. Therefore, it is necessary to prevent the sheet from entering the inside of the apparatus as much as possible.

SUMMARY OF THE INVENTION

The present invention has been made in order to solve the above problems, and an object thereof is to provide an image forming apparatus capable of detecting, without fail, the sheet that has been stuck to the intermediate transfer belt as well as preventing the sheet from entering the inside of the apparatus by the movement of the intermediate transfer belt with a simple structure.

To solve the above problem, according to the present invention, there is provided an image forming apparatus including: an intermediate transfer belt having a belt surface on which a toner image is formed while the belt surface is moved and transferring the toner image that has been formed on the belt surface onto a sheet to be fed by a feed section; a resist roller pair that is disposed at a position on the upstream side from a transfer position at which the toner image that has been formed on the belt surface is transferred onto the sheet in the sheet feeding direction and performs a resist operation before the sheet has been fed to the transfer position as well as constitutes the feed section; a belt surface sensor that is disposed at a position on the downstream side from the transfer position in the belt surface moving direction such that the sheet moving distance from the sheet holding position between the resist roller pair to the position becomes shorter than the length of the sheet in the feeding direction and detects the sheet on the belt surface; and a control unit that allows the feed section to stop the sheet feeding operation at the time when the belt surface sensor detects the sheet.

Furthermore, according to the another aspect of the present invention, there is provided an image forming method comprising the steps of:

forming a toner image on an intermediate transfer belt having a belt surface while the belt surface is moved and transferring the toner image that has been formed on the belt surface onto a sheet to be fed by a feed section;

performing a resist operation before the sheet has been fed to the transfer position by a resist roller pair which constitutes the feed section, disposed at a position on the upstream side from the transfer position at which the toner image that has been formed on the belt surface is transferred onto the sheet in the sheet feeding direction;

detecting the sheet on the belt surface by a belt surface sensor that is disposed at a position on the downstream side from the transfer position in the belt surface moving direction such that the sheet moving distance from the sheet holding position between the resist roller pair to the position becomes shorter than the length of the sheet in the feeding direction; and allowing the feed section to stop the sheet feeding operation by a control unit at the time when the belt surface sensor detects the sheet.

DETAILED DESCRIPTION OF THE INVENTION

Embodiments of the present invention will be described below with reference to the accompanying drawings.

(First Embodiment)

A first embodiment of the present invention will be described below.

Figure 1:
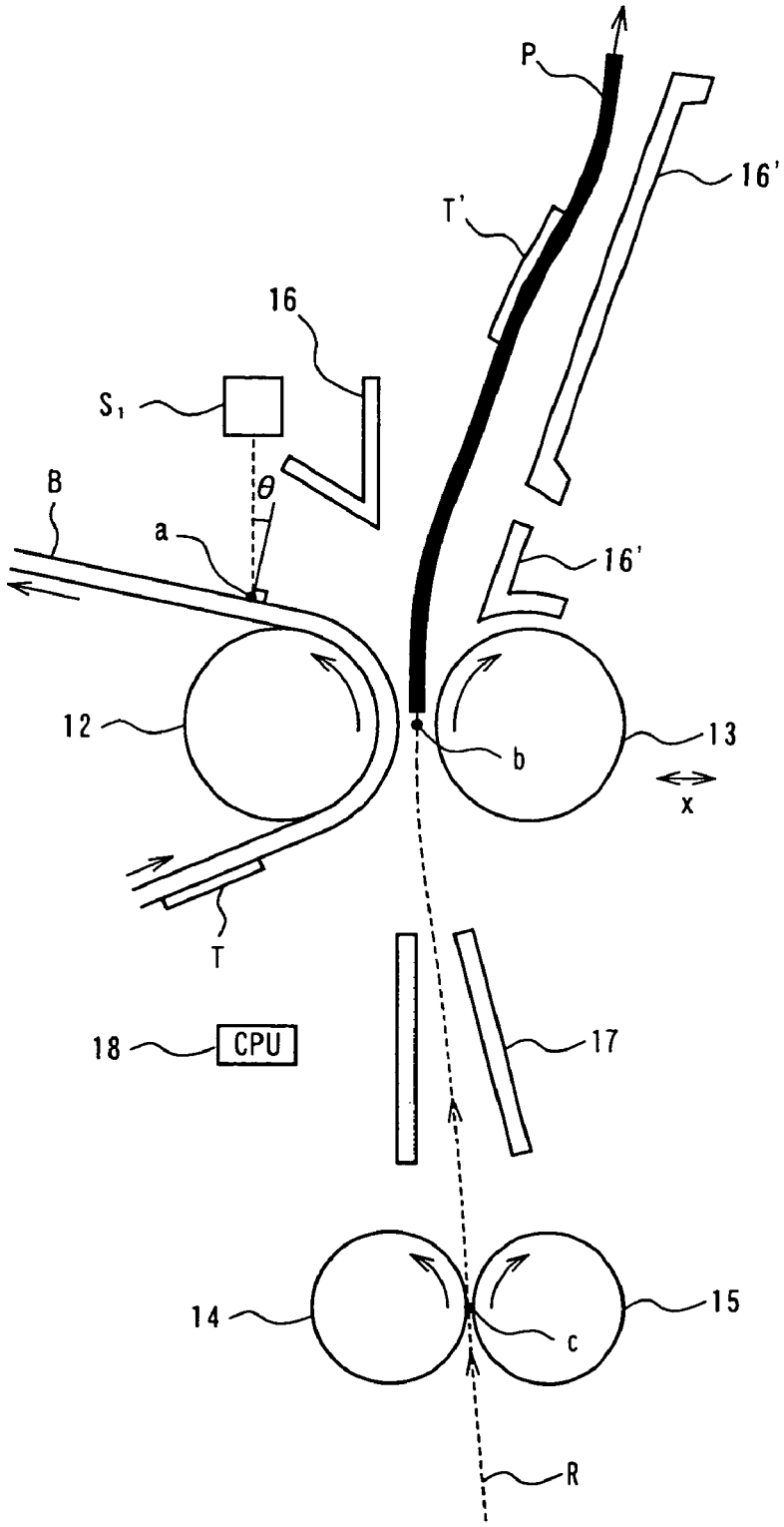
FIG. 1 is a configuration diagram for explaining an image forming apparatus according to a first embodiment of the present invention.

FIG. 1 is a configuration diagram for explaining an image forming apparatus according to the first embodiment of the present invention.

The image forming apparatus according to the present embodiment includes an intermediate transfer belt B supported by a plurality of rollers including a roller 12 (rollers other than the roller 12 are not shown), a secondary transfer roller 13, resist rollers 14 and 15 constituting a resist roller pair, feed guides 16 and 17, a CPU (control unit) 18, and a belt surface sensor S1.

A normal sheet feeding operation of the apparatus will be described at first. The same operation as the conventional configuration is performed since a sheet on which a toner image is formed has been supplied to a sheet feeding line until the sheet is fed to the resist roller pair, and the description thereof will be omitted here.

After being fed through a sheet feeding line R, a sheet P reaches the resist roller pair constituted by the resist rollers 14 and 15. The sheet P is then butted to a nip portion c of the resist roller pair and subjected to resist processing such as timing adjustment and skew correction.

After completion of the resist processing, the sheet P that has been subjected to timing adjustment and skew correction is fed to a transfer position b at which the secondary transfer roller 13 and the belt surface of the intermediate transfer belt B abut each other while being guided by the feed guide 17. The secondary transfer roller 13 is provided in a movable manner in x direction so as to be in contact with or spaced from the belt surface of the intermediate transfer belt B.

A desired toner image T is formed on the belt surface of the intermediate transfer belt B through a not shown developing unit (toner image is formed while the belt surface is being moved). The toner image T is fed to the transfer position b and then transferred onto the sheet P while being pressed against the belt surface by the secondary transfer roller 13.

The sheet P having the transferred toner image T' is fed through the normal sheet feeding line R while being guided by the feed guide 16. The toner image T' is then heated and fixed by a not shown fixing unit.

Next, a sheet feeding operation in the case where the sheet P is stuck to the belt surface of the intermediate transfer belt B and is thereby not fed through the normal feeding line R will be described.

Figure 2:
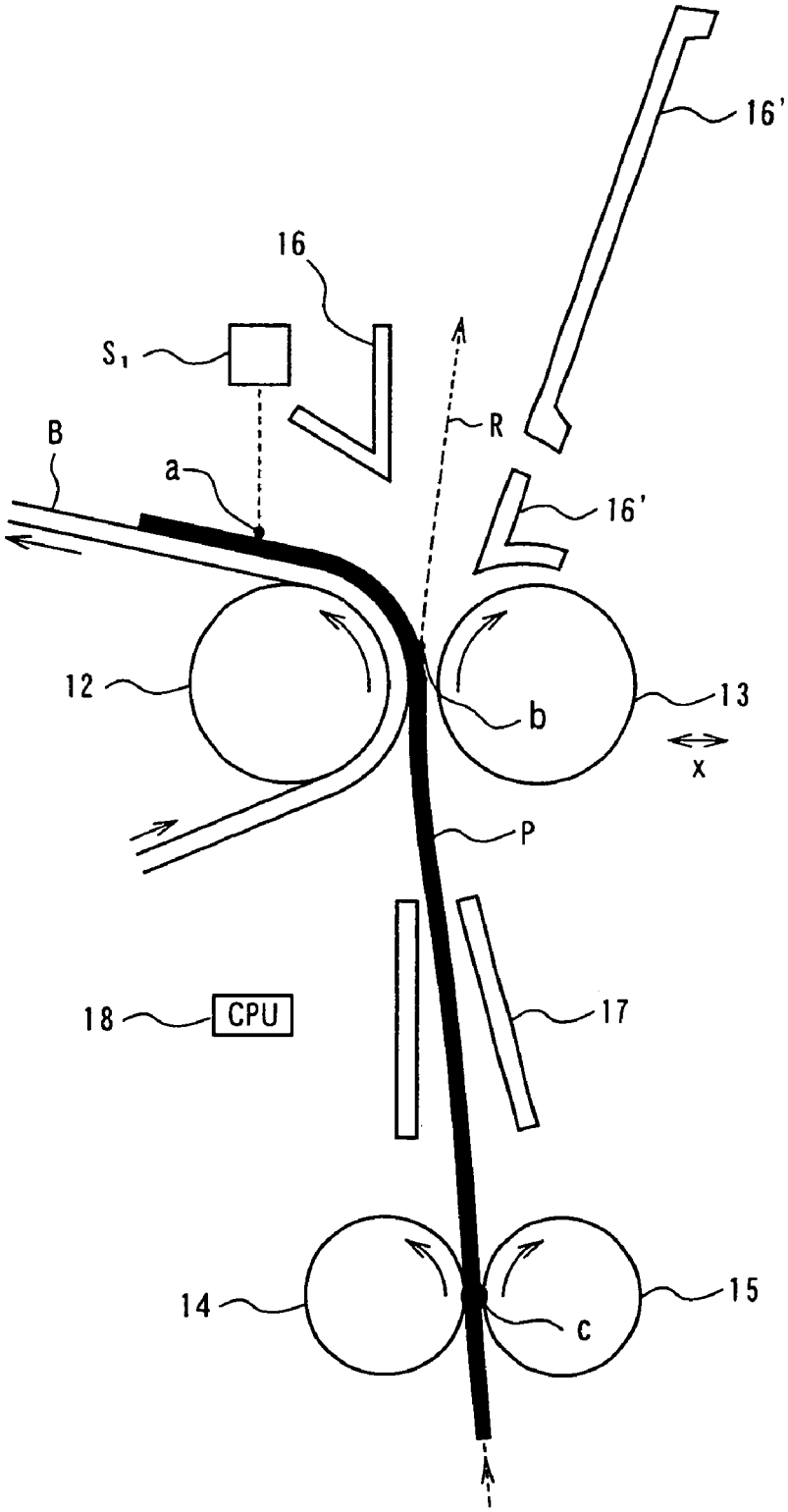
FIG. 2 is a view showing the state where a sheet is stuck to an intermediate transfer belt in the image forming apparatus according to the embodiment.

FIG. 2 is a view showing the state where the sheet is stuck to the intermediate transfer belt in the image forming apparatus according to the embodiment.

When the sheet P onto which a toner image has been transferred at the transfer position b is stuck to the belt surface of the intermediate transfer belt B, the leading edge (end portion on downstream side in the belt surface moving direction) of the sheet P is moved together with the belt surface and reaches a detection position a, where the adhesion of the sheet P to the belt surface is detected by the belt surface sensor S1.

With the detection of the leading edge of the sheet P by the belt surface sensor S1, the CPU 18 allows a feed section to stop the feeding operation of the sheet P.

The term "feed section" here indicates a means to perform the feeding operation at the time point when the leading edge of the sheet P is detected and corresponds to not shown feeding rollers arranged along the sheet feeding line R, resist rollers 14 and 15, a not shown driving section to drive the intermediate transfer belt B, and the like.

More specifically, in the case where the sheet P is held between, for example, the resist rollers 14 and 15 and between the intermediate transfer belt B and secondary transfer roller 13 at the time point when the leading edge of the sheet P is detected by the belt surface sensor S1, the CPU 18 stops driving of the resist rollers 14 and 15 and the intermediate transfer belt B to allow the secondary transfer roller 13 that has been pressed against the belt surface to come free from the belt surface. In the present embodiment, the belt surface sensor S1 is disposed at a position on the downstream side from the transfer position b in the belt surface moving direction such that the sheet moving distance from the belt surface sensor S1 to the sheet holding position c between the resist rollers 14 and 15 becomes shorter than the length of the sheet P in the feeding direction. The belt surface sensor is thus disposed and detects the sheet on the belt surface. That is, at the time point when the belt surface sensor S1 detects the sheet (the sheet that has been stuck to the belt surface) on the belt surface of the intermediate transfer belt, the sheet is still held by the resist roller pair. Therefore, it is possible to transmit braking force caused by the resist roller pair to the sheet to be stopped, thereby effectively slowing down the sheet moving. The distance from the detection position a of the belt surface sensor S1 to the sheet holding position c between the resist rollers 14 and 15 is set within the distance that the sheet is moved within the braking time, that is, from the time at which driving of the resist roller pair is stopped to the time at which the sheet is stopped completely. In practice, any margin is added to the above distances in consideration of variations in the sheet detection time of the belt surface sensor and in the mechanism in the apparatus.

It is difficult to promptly stop the sheet that has been electrostatically stuck to the belt surface only by stopping the intermediate transfer belt. In the case of the configuration in which motive energy is transmitted to the resist rollers 14 and 15 from a clutch to rotatively drive the resist rollers, the effective way for stopping the sheet feeding is to slow down the sheet by turning the clutch of the resist rollers OFF.

On the other hand, in the case where the resist rollers 14 and 15 are directly driven by a motor, it is possible to promptly stop the sheet feeding, in some cases, only by stopping the motor that drives the resist rollers 14 and 15 since the stop of the motor allows the holding torque of the motor to promptly slow down the sheet.

The reason why the secondary transfer roller 13 is separated from the belt surface is to prevent, as much as possible, the secondary transfer roller 13 from being contaminated by residual toners or the like. Further, it is desirable to separate the secondary transfer roller 13 from the belt surface before driving of the resist roller pair is stopped in order to prevent the belt surface from being scratched.

The belt surface sensor S1 that detects the sheet on the belt surface is disposed at a position on the downstream side from the transfer position b, at which a toner image that has been formed on the belt surface is transferred onto the sheet, in the moving direction of the belt surface of the intermediate transfer belt B.

More specifically, the belt surface sensor S1 detects the sheet on the belt surface of the intermediate transfer belt B at the detection position a. The detection position a is located such that the distance from the detection position a to the sheet holding position c between the resist roller pair becomes shorter than the length of the sheet P in the feeding direction as described above. As a result, even if the feed section is allowed to stop its sheet feeding operation after the belt surface sensor S1 has detected the leading edge of the sheet (after the belt surface sensor S1 has detected adhesion of the sheet to the belt surface), the sheet is stopped by holding the resist roller pair, so that the sheet is easily removed.

In order for the sheet stuck to the belt surface not to enter the inside of the apparatus, it is desirable to locate the belt surface sensor S1 on the downstream from the transfer position b in the belt surface moving direction and in as close contact as possible with the transfer position b so as to allow the feed section to stop the sheet feeding operation immediately after the belt surface sensor S1 has detected the leading edge of the sheet stuck to the belt surface.

However, for the reason of apparatus configuration, or in view of the case where powder dust or the like may sore near the transfer position to cause the sensor to malfunction, it is not desirable to locate the belt surface sensor at the position too near the transfer position b.

In consideration of the above reason or case, the belt surface sensor S1 is disposed at the position behind the feed guide 16 (see FIG. 1) and relatively near the transfer position b, thereby suppressing occurrence of the improper operation caused by powder dust or the like.

In the image forming apparatus that adopts the method of transferring the toner image formed on the intermediate transfer belt onto the sheet, all the toner images are not always transferred onto the sheet, but a part of the toners may not be transferred and remain on the belt surface.

Since the residual toner on the belt surface has a certain degree of thickness, the belt surface sensor S1 erroneously detects the residual toner having the certain degree of thickness as the sheet in some cases. The erroneous detection as described above may cause the sheet feeding operation to uselessly be stopped to adversely affect processing effect of the image forming apparatus.

Therefore, it is necessary that the belt surface sensor S1 have the configuration that does not detect the residual toner on the belt surface of the intermediate transfer belt B, but detects only the sheet stuck to the belt surface.

In the present embodiment, a reflective light sensor is used as the belt surface sensor S1. The reflective light sensor can change irradiation angle of the light to the belt surface in order to limit the object to be detected.

A relation between angle of inclination θ of the belt surface sensor S1 relative to the belt surface and the object to be detected is shown below, the relation being obtained from an experiment. More specifically, the angle of inclination θ indicates the tilt angle of the irradiation direction of the light from the belt surface sensor S1 relative to the normal line on the belt surface.

| | |
|---|---|
| Belt surface of transfer belt | 0° to 8° |
| Residual toner | 0° to 12° |

-continued

| | |
|---|---|
| Thin paper | 0° to about 75° |
| Plain paper | 0° to about 75° |

Figure 3:
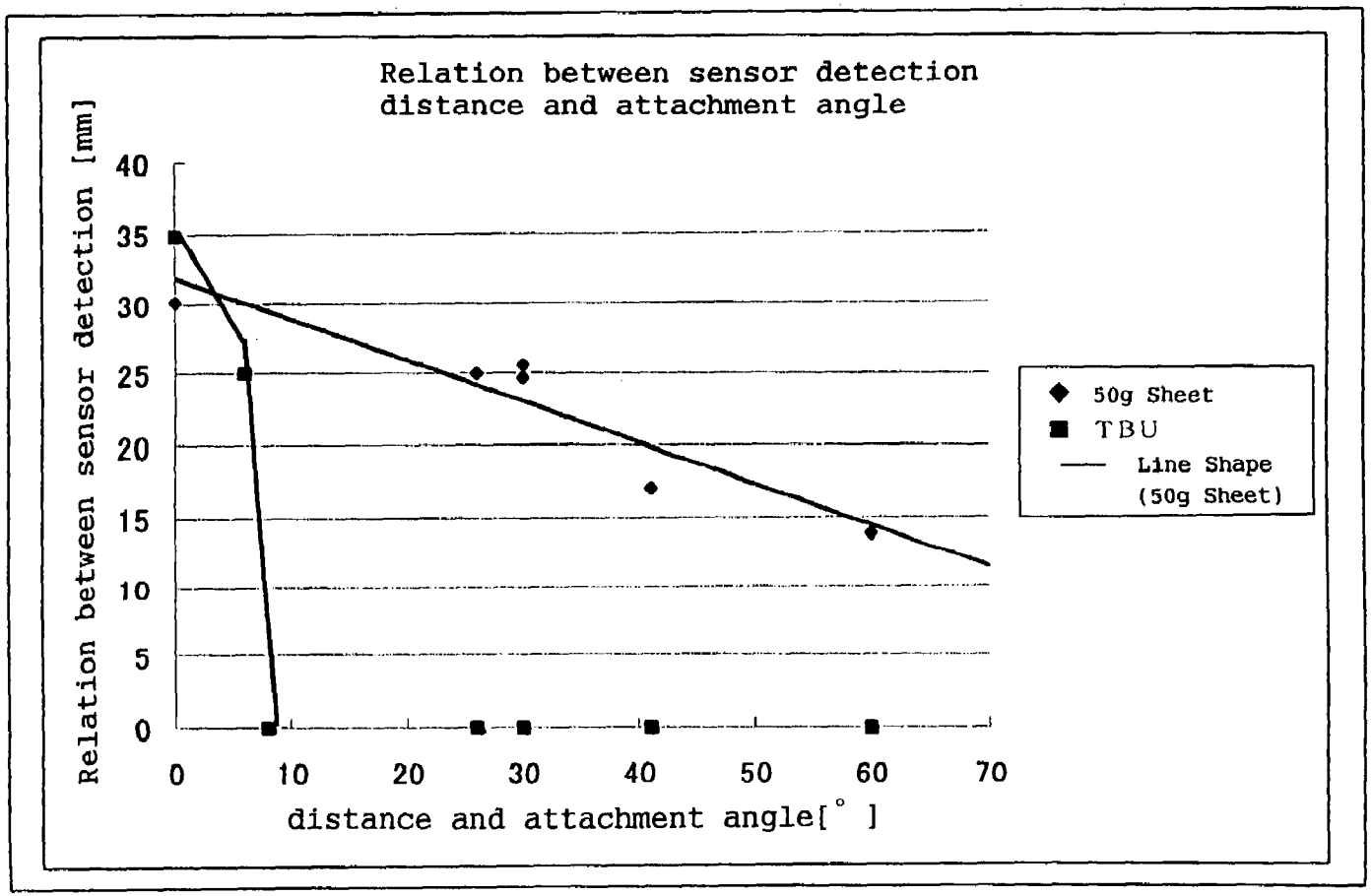
FIG. 3 is a graph for explaining the attachment angle of a belt surface sensor in the image forming apparatus according to the embodiment.

FIG. 3 is a graph for explaining the attachment angel of the belt surface sensor S1 in the image forming apparatus according to the embodiment. The graph shows the data related to the angle range within which the belt surface of the transfer belt can be detected and the angle range within which the sheet can be detected, where the ordinate indicates sensor detection distance (mm) and abscissa indicates sensor attachment angle (angle of inclination θ of the belt surface sensor S1 relative to the belt surface) (°).

As described above, it can be seen that the belt surface sensor S1 needs to be inclined at an angle range of about 13° to 75° in order for the belt surface sensor S1 to detect the sheet having the thickness more than that of a thin paper without detecting the residual toner.

It can be seen from FIG. 3, however, when the belt surface sensor is inclined, the distance within which the object to be detected can be detected changes. Further, when the belt surface sensor is located at the position too near the belt surface, the powder dust or the like may cause the sensor to malfunction. Further, since the sharper the attachment angle of the sensor relative to the belt surface, the weaker a reflected light intensity, it is necessary not to exceed a certain angle in order to maintain the detection accuracy of the sensor. In view of the above conditions, the angle of inclination θ (see FIG. 1) of the belt surface sensor S1 relative to the belt surface is set at a range of 15° to 45°.

With the configuration described above, it is possible to prevent the sheet that has been stuck to the belt surface of the intermediate transfer belt from going off the sheet feeding line and entering the inside of the apparatus. Further, the belt surface sensor is inclined relative to the belt surface in order to discriminate the sheet from the residual toner, thereby preventing the situation (malfunction) in which the sensor erroneously detects the residual toner as the sheet to stop the sheet feeding operation. Furthermore, it is possible to easily remove the sheet that has been stuck to the belt surface of the intermediate transfer belt.

(Second Embodiment)

A second embodiment of the present invention will next be described below.

The second embodiment is a modification of the above-mentioned first embodiment. More specifically, the second embodiment differs from the first embodiment in the configuration in which a signal from a resist switch 19, which is newly provided, is used for the control operation performed in the CPU. In the following, the same reference numerals as the first embodiment are given to the components which are common to the first embodiment, and the overlapped description is omitted.

Figure 4:
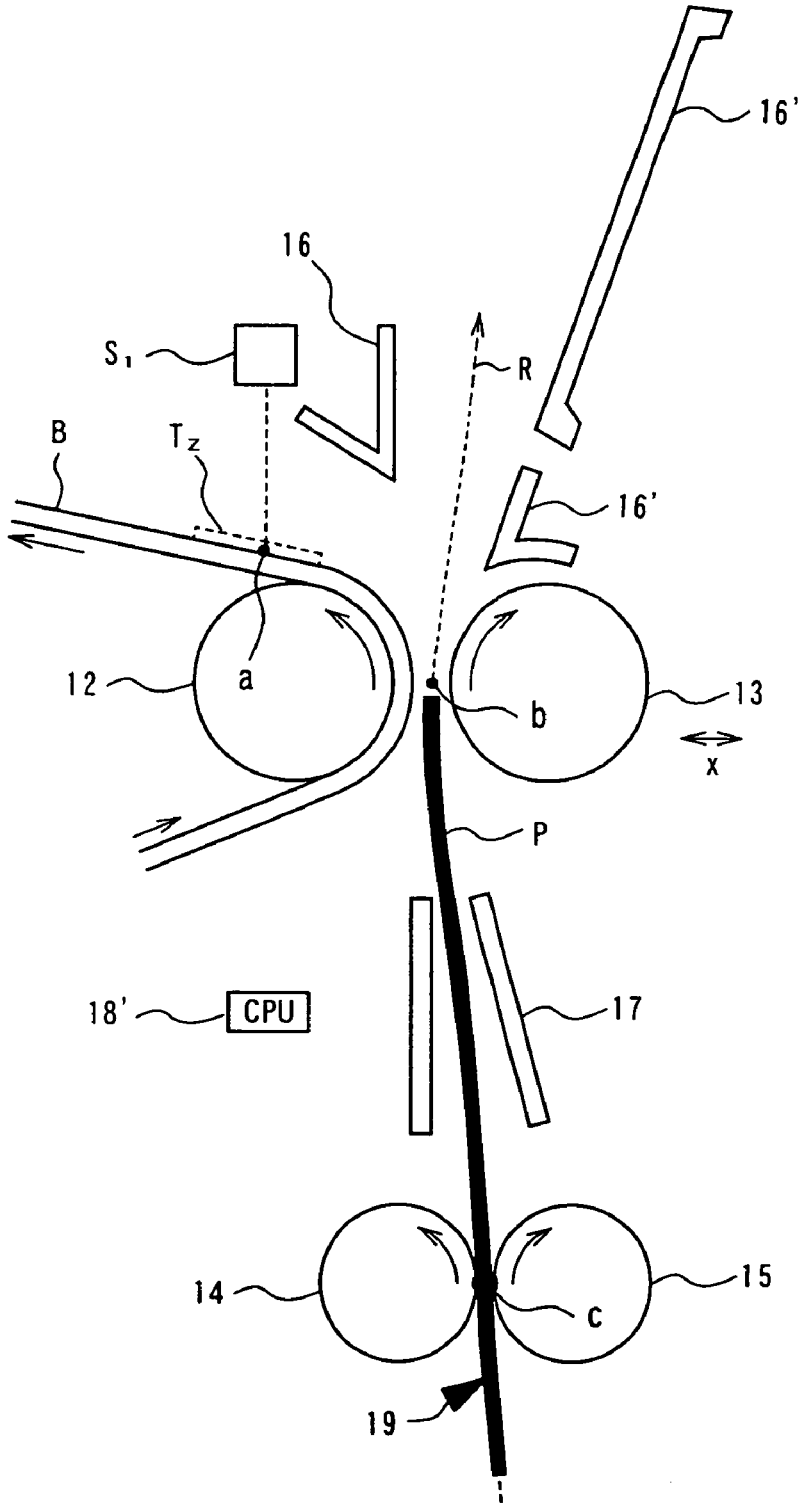
FIG. 4 is a configuration diagram for explaining an image forming apparatus according to a second embodiment of the present invention.

FIG. 4 is a configuration diagram for explaining the image forming apparatus according to the second embodiment of the present invention.

In the second embodiment, the resist switch 19 is disposed at a position on the upstream side from the resist rollers 14 and 15 in the sheet feeding direction in the vicinity thereof, as shown in FIG. 4. When being in contact with the leading edge (end portion on the downstream in the sheet feeding direction) of the sheet that has reached the resist roller pair, the resist switch 19 is turned ON.

The resist roller pair starts its resist operation at the timing based on the ON signal of the resist switch 19.

An operation of the image forming apparatus according to the second embodiment will next be described below.

The CPU 18 allows the feed section to stop the feeding operation of the sheet P at the time when the belt surface sensor S1 detects the sheet P after a predetermined time has passed from the start timing of the resist operation performed by the resist roller pair.

In the case where the residual toner Tz remains on the belt surface of the intermediate transfer belt B, there is a possibility that the belt surface sensor S1 erroneously detects the residual toner Tz as the sheet depending on the thickness or the like of the residual toner Tz although the sensor is inclined for arrangement thereof.

In such a case, the leading edge of the sheet is not supposed to reach the detection position a at which the belt surface sensor S1 can detect the sheet before a predetermined time (time required for the sheet to move from the resist switch 19 to the detection position a) has passed since the resist switch 19 had been tuned ON.

That is, the feed section is allowed to stop the feeding operation of the sheet P only when the belt surface sensor S1 detects the sheet after a predetermined time has passed since the resist switch 19 had been turned ON. With this configuration, it is possible to prevent the sheet feeding operation from being uselessly stopped due to the erroneous detection of the residual toner Tz as the sheet. In this operation, when the belt surface sensor S1 detects the sheet (that is, determines that a detection has been made) within a predetermined time since the resist switch 19 had been turned ON, the detection signal is ignored.

The above predetermined time is determined based on the time from turning-ON of the resist switch 19 to the start of the resist operation performed by the resist roller pair, sheet feeding speed, distance between the resist switch 19 and the detection position a, and the like. While the start timing of the resist operation is determined here based on a signal from the resist switch 19, the present invention is not limited thereto. It is possible to provide a dedicated switch (sensor) in addition to the resist switch 19.

The belt surface sheet S1 detects the sheet by performing sheet detection operation every 8 millisecond, five times total, immediately after a predetermined time has passed. This is because it is rare that all detection results obtained by performing sheet detection operation every 8 millisecond five times indicate "sheet" if the detection target is residual toner and, normally, some discontinuity portions on the toner image must be detected in any of the detection operations. That is, the target object is determined as the sheet when all the results of detection operation performed five times indicate "sheet", whereas the target object is determined as the residual toner even when only one of the five detection results indicates "no sheet".

(Third Embodiment)

A third embodiment of the present invention will next be described.

The third embodiment is a modification of the abovementioned first embodiment. More specifically, the third embodiment differs from the first embodiment in the configuration in which a signal from a feeding line sensor S2, which is newly provided, is used for the control operation performed in the CPU. In the following, the same reference numerals as the first embodiment are given to the components which are common to the first embodiment, and the overlapped description is omitted.

Figure 5:
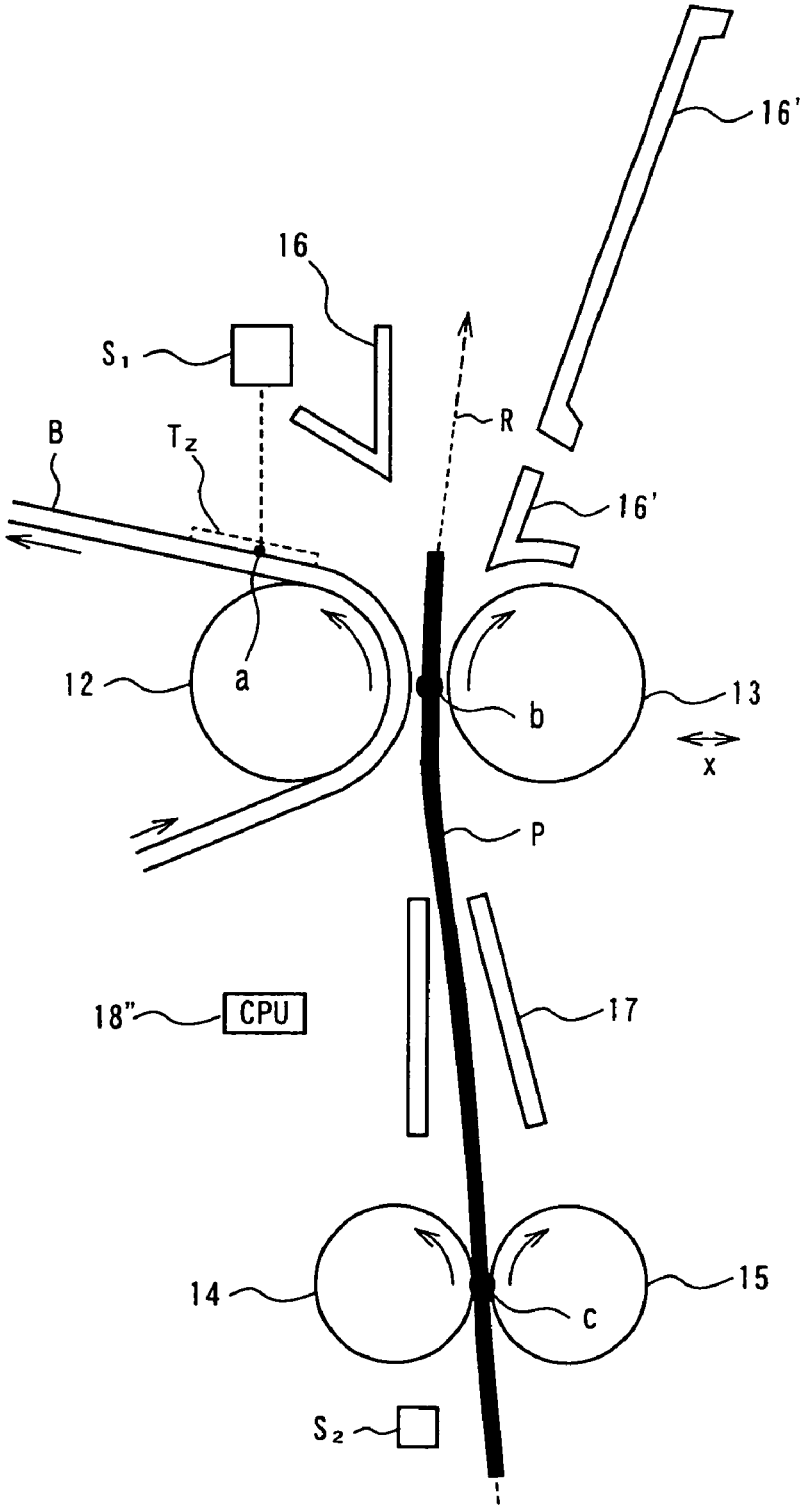
FIG. 5 is a configuration diagram for explaining an image forming apparatus according to a third embodiment of the present invention.

FIG. 5 is a configuration diagram for explaining the image forming apparatus according to the third embodiment of the present invention.

In the third embodiment, the feeding line sensor S2 is disposed at a position on the upstream side from the transfer position b in the sheet feeding direction such that the sheet moving distance from the feeding line sensor S2 to the detection position a of the belt surface sensor S1 becomes longer than the length of the sheet in the feeding direction (see FIG. 5). The feeding line sensor S2 detects the sheet that passes through the sheet feeding line R at a position in the vicinity thereof.

An operation of the image forming apparatus according to the third embodiment will next be described below.

The CPU 18 does not allow the feed section to stop the sheet feeding operation when both the feeding line sensor S2 and belt surface sensor S1 detect the sheet.

As described in the second embodiment, in the case where the residual toner Tz remains on the belt surface of the intermediate transfer belt B, there is a possibility that the belt surface sensor S1 erroneously detects the residual toner Tz as the sheet depending on the thickness or the like of the residual toner Tz although the sensor is inclined for arrangement thereof.

Even if the sheet P is stuck to the intermediate transfer belt B in the above situation, the sheet is not supposed to reach the detection position a while the feeding line sensor S2 is detecting the sheet by disposing the feeding line sensor S2 such that the sheet moving distance from the feeding line sensor S2 to the detection position a becomes longer than the length of the sheet P.

That is, in the configuration according to the third embodiment, the simultaneous detections of the sheet by the feeding line sensor S2 and belt surface sensor S1 indicate that the belt surface sensor S1 has erroneously detected the residual toner Tz as the sheet. In such a case, the CPU 18" does not allow the feed section to stop the sheet feeding operation, thereby preventing the sheet feeding operation from being uselessly stopped.

While the invention has been described in detail and with reference to specific embodiments thereof, it will be apparent to one of ordinary skill in the art that various changes and modifications can be made therein without departing from the spirit and scope thereof.

The invention claimed is:

1. An image forming apparatus comprising:

an intermediate transfer belt having a belt surface on which a toner image is formed while the belt surface is moved and transferring the toner image that has been formed on the belt surface onto a sheet to be fed by a feed section;

a resist roller pair that is disposed at a position on the upstream side from a transfer position at which the toner image that has been formed on the belt surface is transferred onto the sheet in the sheet feeding direction and performs a resist operation before the sheet has been fed to the transfer position as well as constitutes the feed section;

a belt surface sensor that is disposed at a position on the downstream side from the transfer position in the belt surface moving direction such that the sheet moving distance from the sheet holding position between the resist roller pair to the position is shorter than the length of the sheet in the feeding direction and detects the sheet on the belt surface;

a control unit that allows the feed section to stop the sheet feeding operation at the time when the belt surface sensor detects the sheet; and a feed guide that guides the sheet at a position on the downstream side from the transfer position in the sheet feeding direction, wherein the belt surface sensor is disposed at a position behind and near the feed guide.

2. The image forming apparatus according to claim 1, wherein the control unit allows the feed section to stop the sheet feeding operation at the time when the belt surface sensor detects the sheet after a predetermined time has passed from the start timing of the resist operation performed by the resist roller pair.

3. The image forming apparatus according to claim 1, comprising a feeding line sensor that is disposed at a position on the upstream side from the transfer position in the sheet feeding direction such that the sheet moving distance from the position to the feeding line sensor to the detection position of the belt surface sensor is longer than the length of the sheet in the feeding direction and detects the fed sheet, wherein the control unit does not allow the feed section to stop the sheet feeding operation when both the feeding line sensor and belt surface sensor detect the sheet simultaneously.

4. The image forming apparatus according to claim 1, wherein the belt surface sensor is a light sensor and is disposed at an angle between 15° to 45° relative to the belt surface.

5. The image forming apparatus according to claim 1, wherein the control unit stops driving of the resist roller pair and the belt at the time when the belt surface sensor detects the sheet.

6. The image forming apparatus according to claim 5, further comprising:

a transfer roller adapted to move so as to be in contact with or spaced apart from the belt surface.

7. The image forming apparatus according to claim 6, wherein the control unit separates the transfer roller from the belt surface before stopping the driving of the resist roller pair.

8. The image forming apparatus according to claim 2, comprising a resist switch that detects the sheet at the time when the sheet is in contact with the resist switch disposed at a position on the upstream side from the resist roller pair in the sheet moving direction, wherein the control unit detects the resist operation start timing by the operation of the resist switch.

9. An image forming apparatus comprising:

an intermediate transfer belt having a belt surface on which a toner image is formed while the belt surface is moved and transferring the toner image that has been formed on the belt surface onto a sheet to be fed by a feed section;

a resist roller pair that is disposed at a position on the upstream side from a transfer position at which the toner image that has been formed on the belt surface is transferred onto the sheet in the sheet feeding direction and performs a resist operation before the sheet has been fed to the transfer position as well as constitutes the feed section;

a belt surface sensor that is disposed at a position on the downstream side from the transfer position in the belt surface moving direction such that the sheet moving distance from the sheet holding position between the resist roller pair to the position is shorter than the length of the sheet in the feeding direction and detects the sheet on the belt surface; and a control unit that allows the feed section to stop the sheet feeding operation at the time when the belt surface sensor detects the sheet, wherein, when the belt surface sensor detects the sheet more than once in a given amount of time, the control unit determines that the sheet has been detected and allows the feed section to stop the sheet feeding operation.

10. An image forming method comprising the steps of:

forming a toner image on an intermediate transfer belt having a belt surface while the belt surface is moved and transferring the toner image that has been formed on the belt surface onto a sheet to be fed by a feed section;

performing a resist operation before the sheet has been fed to the transfer position by a resist roller pair which constitutes the feed section, disposed at a position on the upstream side from the transfer position at which the toner image that has been formed on the belt surface is transferred onto the sheet in the sheet feeding direction;

detecting the sheet on the belt surface by a belt surface sensor that is disposed at a position on the downstream side from the transfer position in the belt surface moving direction such that the sheet moving distance from the sheet holding position between the resist roller pair to the position is shorter than the length of the sheet in the feeding direction; and allowing the feed section to stop the sheet feeding operation by a control unit at the time when the belt surface sensor detects the sheet;

wherein a feed guide that guides the sheet is provided at a position on the downstream side from the transfer position in the sheet feeding direction, and wherein the belt surface sensor is disposed at a position behind and near the feed guide.

11. The image forming method according to claim 10, wherein the control unit allows the feed section to stop the sheet feeding operation at the time when the belt surface sensor detects the sheet after a predetermined time has passed from the start timing of the resist operation performed by the resist roller pair.

12. The image forming method according to claim 10, wherein a feeding line sensor is disposed at a position on the upstream side from the transfer position in the sheet feeding direction such that the sheet moving distance from the position to the feeding line sensor to the detection position of the belt surface sensor is longer than the length of the sheet in the feeding direction and detects the fed sheet, and wherein the control unit does not allow the feed section to stop the sheet feeding operation when both the feeding line sensor and belt surface sensor detect the sheet simultaneously.

13. The image forming method according to claim 10, wherein the belt surface sensor is a light sensor and is disposed at an angle between 15° to 45° relative to the belt surface.

14. The image forming method according to claim 10, wherein the control unit stops driving of the resist roller pair and the belt at the time when the belt surface sensor detects the sheet.

15. The image forming method according to claim 14, wherein, when a transfer roller is pressed to the belt surface, the control unit separates the transfer roller from the belt surface.

16. The image forming method according to claim 15, wherein the control unit separates the transfer roller from the belt surface before stopping the driving of the resist roller pair.

17. The image forming method according to claim 11, wherein a resist switch that detects the sheet at the time when the sheet is in contact with the resist switch is disposed at a position on the upstream side from the resist roller pair in the sheet moving direction, and wherein the control unit detects the resist operation start timing by the operation of the resist switch.

18. An image forming method comprising the steps of:

forming a toner image on an intermediate transfer belt having a belt surface while the belt surface is moved and transferring the toner image that has been formed on the belt surface onto a sheet to be fed by a feed section;

performing a resist operation before the sheet has been fed to the transfer position by a resist roller pair which constitutes the feed section, disposed at a position on the upstream side from the transfer position at which the toner image that has been formed on the belt surface is transferred onto the sheet in the sheet feeding direction;

detecting the sheet on the belt surface by a belt surface sensor that is disposed at a position on the downstream side from the transfer position in the belt surface moving direction such that the sheet moving distance from the sheet holding position between the resist roller pair to the position is shorter than the length of the sheet in the feeding direction; and allowing the feed section to stop the sheet feeding operation by a control unit at the time when the belt surface sensor detects the sheet;

wherein, when the belt surface sensor detects the sheet more than once in a given amount of time, the control unit determines that the sheet has been detected and allows the feed section to stop the sheet feeding operation.

* * * * *